US007448813B2

(12) United States Patent
Penzo

(10) Patent No.: US 7,448,813 B2
(45) Date of Patent: Nov. 11, 2008

(54) HEAT TRANSFER PRINTING DEVICE AND PRINTING METHOD

(75) Inventor: Mirko Penzo, Barcelona (ES)

(73) Assignee: ITW Espana, S. A., Barcelona (ES)

( * ) Notice: Subject to any disclaimer, the term of this patent is extended or adjusted under 35 U.S.C. 154(b) by 122 days.

(21) Appl. No.: 10/986,991

(22) Filed: Nov. 15, 2004

(65) Prior Publication Data

US 2005/0117956 A1 Jun. 2, 2005

(30) Foreign Application Priority Data

Dec. 1, 2003 (ES) ..... 200302818

(51) Int. Cl.
*B41J 35/28* (2006.01)
*B41J 33/14* (2006.01)

(52) U.S. Cl. ..... 400/235; 400/234; 400/236; 400/229; 400/223

(58) Field of Classification Search ..... 400/234, 400/236, 236.2, 223, 229, 233; 347/217, 347/218

See application file for complete search history.

(56) References Cited

U.S. PATENT DOCUMENTS 4,661,004 A * 4/1987 Applegate et al. ..... 400/234
5,975,777 A 11/1999 Nelson et al.
6,261,012 B1 * 7/2001 Haas et al. ..... 400/208
2002/0012559 A1 * 1/2002 Takahashi et al. ..... 400/234

FOREIGN PATENT DOCUMENTS

| | | |
|---|---|---|
| EP | 0 899 116 | 3/1999 |
| GB | 1 067 337 | 5/1967 |
| JP | 04368868 | * 12/1992 |
| JP | 2000-255149 | * 9/2000 |

* cited by examiner

*Primary Examiner*—Judy Nguyen
*Assistant Examiner*—M. L. Ferguson-Samreth
(74) *Attorney, Agent, or Firm*—Vangelis Economou; IPHorgan, Ltd.; Jay Saltzman

(57) ABSTRACT

Incorporates means for maintaining a constant tension in the printing ribbon (3) consisting of a loading drum (9-9') placed after the thermal print head (1) that attracts the ribbon to define a loop, thereby maintaining a constant tension throughout the printing stage to ensure the quality of this operation. The printing method consists of attracting or suctioning the printing ribbon (1) against the loading drum (9-9'), using an electrostatic system that involves creating an electric field between conductors (10) placed on the loading drum (9), or a pneumatic system that involves attracting the ribbon (1) by Venturi tubes (17) located inside the loading drum (9').

8 Claims, 4 Drawing Sheets

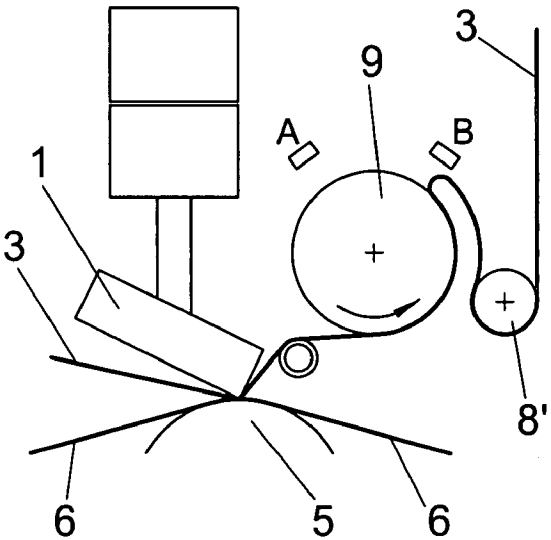
FIG.4
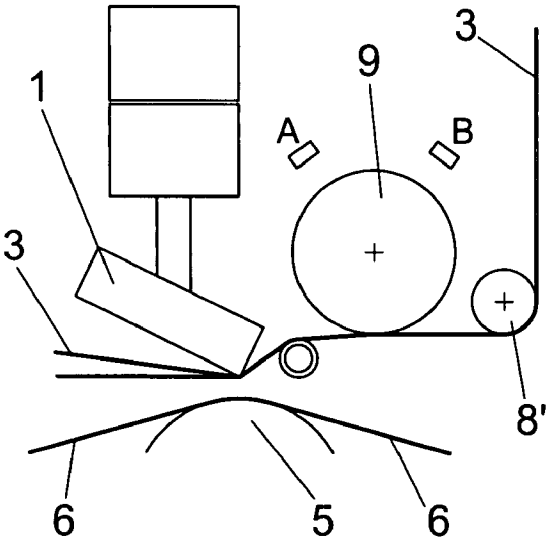
FIG.3
FIG.2

HEAT TRANSFER PRINTING DEVICE AND PRINTING METHOD

RELATED APPLICATIONS

The present application is based on, and claims priority from, Spanish Application Number ES 200302818, filed Dec. 1, 2003, the disclosure of which is hereby incorporated by reference herein in its entirety.

OBJECT OF THE INVENTION

The present invention relates to a printing device of application in heat transfer printing machines, as well as to the printing method itself.

The object of the invention is that the printing device incorporates means to provide a constant tension of the printing ribbon and that these means are mainly based on the incorporation of a loading drum placed immediately after the thermal print head that draws the ribbon towards it to form a loop, thereby maintaining a constant tension during the printing stage to ensure the quality of this operation.

Also the object of the invention is that the method used for the printing process consists of suctioning or attracting the printing ribbon on a loading drum; this suction can be performed by different means, among which can be cited an electrostatic system, by creating an electric field between conductors placed on the loading drum, or a pneumatic system, by attracting the ribbon by the effect of Venturi tubes placed inside the loading drum.

BACKGROUND OF THE INVENTION

Printing machines with a thermal head transfer the ink from a printing ribbon to the material to be printed by heating a number of points in the thermal print head to release the ink.

In a first generation of printing machines, the transfer ribbon transport means were driven by a motor in the take-up spool and were provided with various possible combinations of braking devices in the feed spool to control the amount of ribbon supplied.

During the printing stage it is crucial that the tension of the transfer ribbon be as constant as possible in order to obtain a high printing quality. In this sense, some manufacturers have developed moving devices that move to maintain the ribbon tension constant, thereby resulting in a relative motion between the print head and the ribbon, with the feed spool and take-up spool still.

This is the case in U.S. Pat. No. 5,975,777, which relates to a printing apparatus incorporating a shuttle that constitutes the transport element of the ribbon with respect to the thermal head during printing, while at least one of the spools remains still.

Other solutions used to maintain a constant ribbon tension involve acting on the various speeds of the feed and take-up spool motors.

These systems result complex and hard to manage, having poor precision as well as speed-related limitations determined by the inertia of the mechanical devices when these are set in motion, so that it is convenient to develop a device to solve the above-described problems.

DESCRIPTION OF THE INVENTION

The heat transfer printing device that constitutes the object of this invention fully solves the needs described above as it ensures a constant tension of the print head during the printing stage in a simple manner.

The device is fundamentally based on the incorporation of a loading drum provided with the required elements for attracting the printing ribbon, placed between the thermal print head and the ribbon take-up spool, on which the ribbon adheres to form a loop that increases, tensioned, during the printing stage.

In a main embodiment of the invention, the surface of the drum has two alternating and distanced electrical conductors, one connected to a positive terminal and the other to a negative terminal of a d.c. power supply. This gives them a potential difference that creates an electric field strong enough to attract the print ribbon against the drum.

The attractive force generated by the drum on the print ribbon will depend on the structural configuration of the conductors and the distance between them, as well as on their potential difference. The electrical conductors can be wires, printed circuits or other.

As the drum revolves in the sense corresponding to the advance of the ribbon, the ribbon attracted by the drum extends in a loop with a variable length, determining a tension that is maintained constant during the printing process to provide a greater printing quality.

The ribbon remains tense during the printing stage, which will begin when the speed of the printing ribbon and that of the material to be printed are the same.

The amount of ribbon transferred is controlled by a rotation sensor associated to a guide roller, which controls the tangential speed of this roller and informs of the amount of ribbon transferred to thereby facilitate regulation of the revolution parameters of the ribbon feed spool motor and take-up spool motor.

The loop is then rewound by the required amount according to the size of the printing by a motor associated to the printing ribbon take-up spool. To facilitate the take-up of this loop, the ribbon is tensioned by a brake placed before the take-up spool.

The loop start and end process is determined by corresponding sensors placed near the loading drum. Thus, when the ribbon reaches the position of the first sensor it will be detected and when printing begins the loop will be extended, while when the ribbon reaches the position of the second sensor it will also be detected, activating the printed ribbon take-up system by the required amount.

An alternative solution would involve the use of a drum provided with slits arranged longitudinally along its cylindrical generatrix, which are connected by orifices to Venturi tubes inside the drum in which pressurised air is injected to create a suction force through the orifices and the slits, thereby holding the printing ribbon against the drum.

The operation of the printing device can be summarised by the following operations:

- Detection of the instantaneous speed of the material to be printed by an external speed sensor in contact with it;
- Delivery of a printing activation signal by an external signal (sensors or other devices) for the start of printing;
- Activation of the thermal print head to bring it near the material to be printed,
- Activation of the printing ribbon feed spool motor;
- Activation of the suitable mechanisms, electrostatic (high-voltage generator), pneumatic (pressurised air) or others, in order to load and attract he transfer ribbon on the loading drum to form the loop;
- Placing the thermal print head near the transfer ribbon and printing on the material to be printed;
- Activation of the printed transfer ribbon take-up spool to unload the loop formed on the loading drum, according to a sequence determined by the first and second sensors;

Rotation of the feed spool motor in the opposite sense to recover the transfer ribbon lost during the acceleration of the feed spool and approaching of the thermal print head motor to the material to be printed;

Deactivation of the transfer ribbon take-up spool motor by the required amount according to the printing size.

DESCRIPTION OF THE DRAWINGS

To complete the description being made and in order to aid a better comprehension of the characteristics of the invention, according to an example of a preferred embodiment, the present description is accompanied by a set of drawings forming an integral part of it in which, for purposes of illustration and in a non-limiting sense, the following has been shown:

FIGS. 2 to 4.—Show views of the transfer ribbon tensioning sequence in which a loop is formed.

PREFERRED EMBODIMENT OF THE INVENTION

Figure 1:
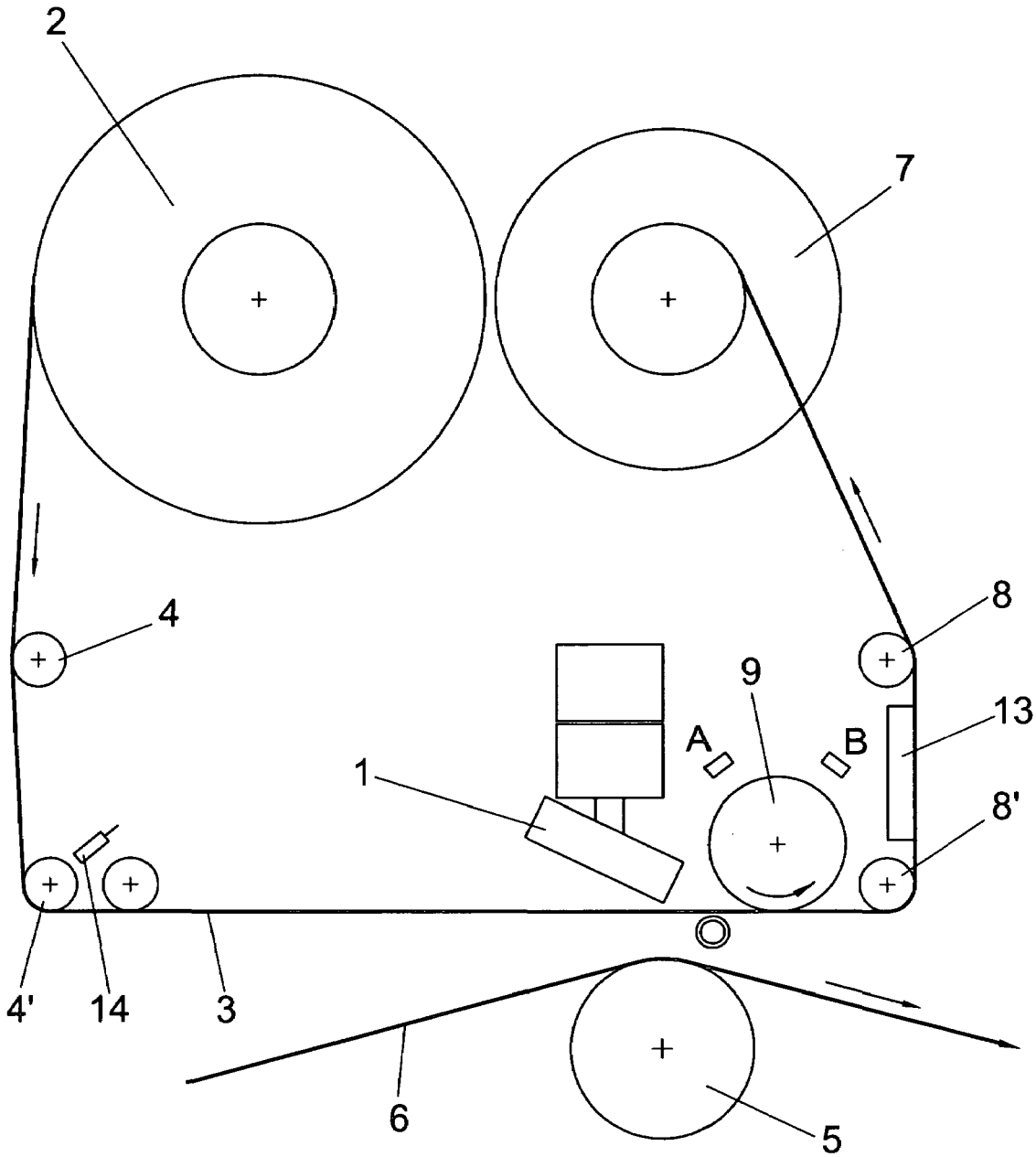
FIG. 1.—Shows a schematic view of the heat transfer printing device that constitutes the object of this invention in the situation immediately prior to the fall of the thermal print head.
Figure 5:
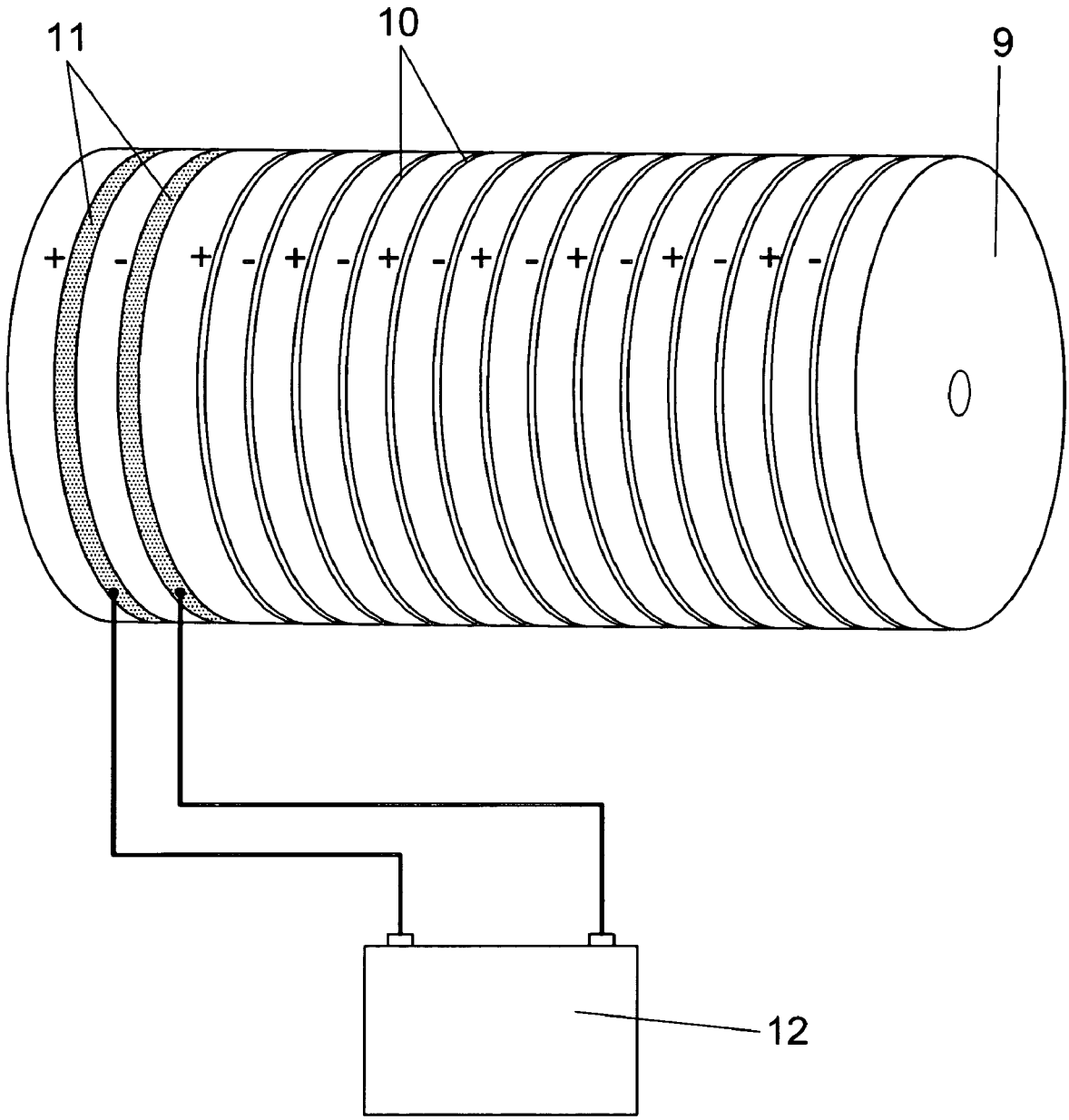
FIG. 5.—Shows a view of the loading drum with electrical conductors according to the preferred embodiment of the invention.
Figure 6:
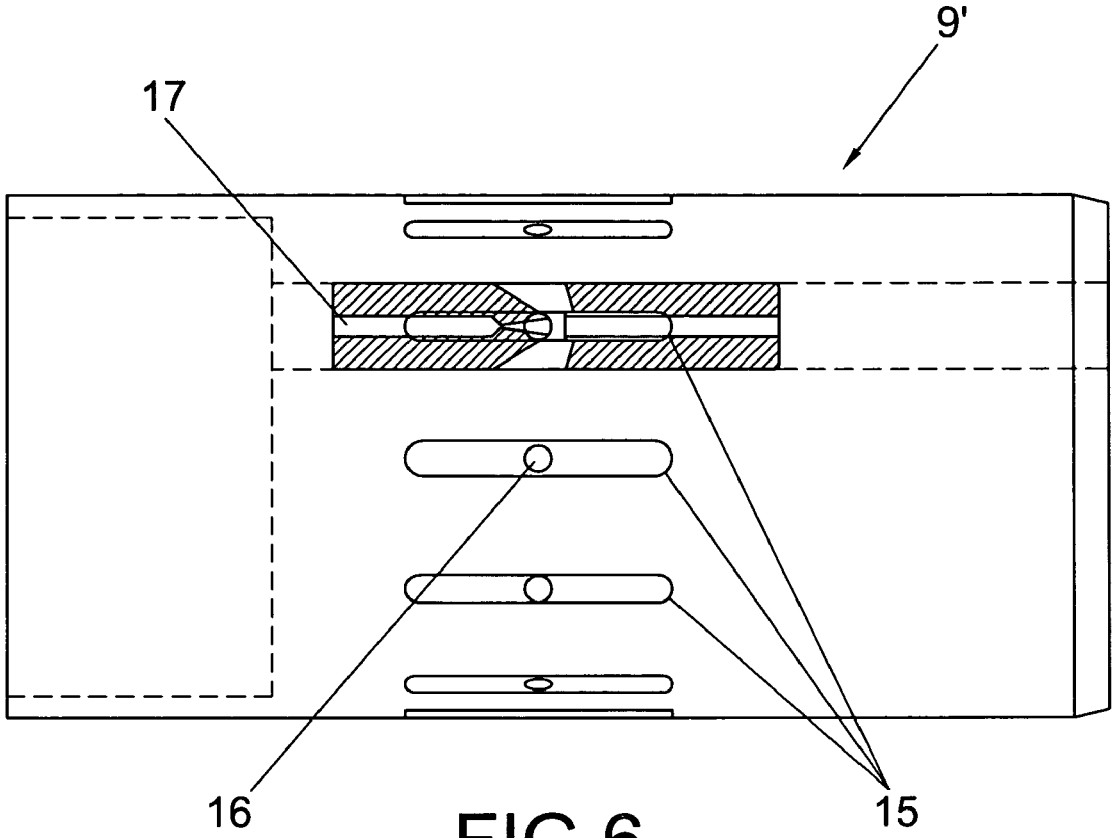
FIG. 6.—Shows a side view of the alternative loading drum in which one of the Venturi ducts is shown in detail.
Figure 7:
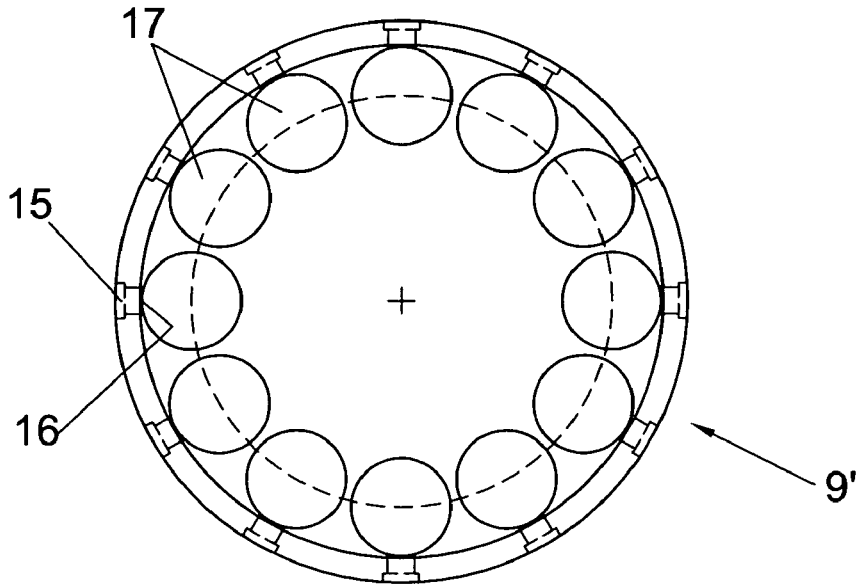
FIG. 7.—Shows an elevation view of the loading drum of FIG. 6, showing the different Venturi ducts.

The heat transfer printing device that is the object of this invention arises from the basic incorporation of a thermal print head (1), a feed spool (2) for printing ribbon (3) drive by a motor, entry guide rollers (4-4') that direct the printing ribbon from the feed spool (2) toward the printing area, where there is a printing roller (5) on which slides the material to be printed (6), also incorporating a take-up spool (7) driven by a motor towards which the printing ribbon (3) is directed with the aid of guide rollers (8-8').

With this configuration, the heat transfer printing device is mainly characterised in that it incorporates a cylindrical loading drum (9-9') placed after the thermal print head (1), onto which the printing ribbon (3) adheres to form a loop, thereby maintaining constant the tension of the ribbon (3) during the printing.

FIGS. 2 to 4 show the sensors A and B corresponding to the minimum and maximum positions between which the loop runs and the printing ribbon (3) is adhered.

In a main embodiment of the invention, the surface of the drum (9) has two alternating and distanced electrical conductors (10), each one connected to corresponding commutator segments (11) connected to a positive and a negative terminal of a d.c. power supply (12) determining a potential difference that creates an electric field between the conductors (10) that is strong enough to attract the printing ribbon (3) against the drum (9).

The printing device has a brake (13) between the guide rollers (8), (8') that partially brakes the printing ribbon (3) to simplify the subsequent loop take-up stage by actuating the take-up loop (7).

On another hand, the heat transfer printing device is provided with a rotation sensor (14) associated to the guide roller (4') that indicates the amount of printing ribbon (3) transferred in order to control the actuation of the motors associated to the feed spool (2) and the take-up spool (7).

In a second embodiment, the loading drum (9') has slits (15) arranged longitudinally along its generatrix, connected by orifices (16) to Venturi tubes (17) arranged axially inside the loading drum (9') through which pressurised air is introduced to create a suction effect through the orifices (16) and the slits (15) on the printing ribbon (3), which is therefore held against the loading drum (9').

The printing method used to keep constant the ribbon tension during the printing mainly consists of the following stages:

Moving the printing ribbon (3) supplied from the feed spool (2);

Displacing the thermal print head (1) toward the printing ribbon (3);

Holding the printing ribbon (3) against the outer surface of the loading drum (9-9'), which revolves to create a loop that will determine a constant tension in the printing ribbon (3) during the printing stage;

Collection of the loop formed on the loading drum (9-9') in the take-up spool (7).

In a main embodiment, the printing ribbon (3) is held against the loading drum (9) by the attraction produced by the electric field created by the potential difference between the conductors (10).

In the secondary embodiment, the printing ribbon (3) is held against the loading drum (9') by the suction generated by the Venturi effect in the longitudinal slits (13) provided in the generatrix of the loading drum (9').

The invention claimed is:

1. A heat transfer printing device comprising:

a thermal print head;

a feed spool for printing ribbon driven by a motor, entry guide rollers that direct the printing ribbon arriving from the feed spool toward the printing area where there is a printing roller on which slides the material to be printed;

a take-up spool driven by a motor to which the printing ribbon is directed with the aid of guide rollers; and a cylindrical loading drum placed after the thermal print head, the loading drum having a surface and configured to have the printing ribbon adhere thereto, the loading drum have slits distributed longitudinally along a generatrix thereof and connected through orifices to Venturi tubes distributed axially inside the loading drum in which pressurized air is introduced to create a suction effect through the orifices and the slits on the printing ribbon that is thereby pressed against the surface of the loading drum, the printing ribbon thereby forming a loop by the rotation of the loading drum in order to maintain tension on the ribbon during printing.

2. The heat transfer printing device according to claim 1, wherein at least one portion of the loop is out of contact with the surface of the drum.

3. The heat transfer printing device according to claim 2, further comprising a brake between exit guide rollers, that partially brakes the printing ribbon to simplify the take-up of the loop in a later stage by actuating the take-up spool.

4. The heat transfer printing device according to claim 1, further comprising a brake between exit guide rollers, that partially brakes the printing ribbon to simplify the take-up of the loop in a later stage by actuating the take-up spool.

5. A heat transfer printing device comprising:

a thermal print head;

a feed spool for printing ribbon driven by a motor, entry guide rollers that direct the printing ribbon arriving from the feed spool toward the printing area where there is a printing roller on which the material to be printed slides;

a take-up spool driven by a motor, to which the printing ribbon is directed with the aid of guide rollers; and a cylindrical loading drum placed after the thermal print head, the loading drum configured to have the printing ribbon adhere thereto, forming a loop by the rotation of the loading drum in order to maintain tension on the ribbon during printing, wherein the drum has on its surface two alternating and distanced electrical conductors, each electrical conductor joined to a corresponding commutator segment connected to a positive and a negative terminal of a d.c. power supply that subjects the electrical conductors to a apotential difference that creates an electric field between the electrical conductors that attracts and attaches the printing ribbon to the drum.

6. The heat transfer printing device according to claim 5, further comprising a brake between exit guide rollers that brakes partially the printing ribbon to simplify the take-up of the loop in a later stage by actuating the take-up spool.

7. A printing method applicable to a heat transfer printing device comprising a feed spool for printing ribbon, a thermal print head on the ribbon and a take-up spool, the method comprising the operations of:

moving the printing ribbon supplied from the feed spool;

displacing of the thermal print head towards the printing ribbon, wherein the printing ribbon adheres to the outer surface of a loading drum placed after the thermal print head, the loading drum having a surface and being configured to revolve with the ribbon thereby forming a loop that determines a constant tension in the printing ribbon during the printing stage, at least one portion of the loop being out of contact with the surface of the drum, the printing ribbon adhering to the loading drum by a suction effect generated through orifices and slits defined in a generatrix of the loading drum by injecting pressurized air in Venturi tubes arranged axially inside the loading drum; and collecting the loop formed on the loading drum in the take-up spool.

8. A printing method applicable to a heat transfer printing device comprising a feed spool for printing ribbon, a thermal print head on the ribbon and a take-up spool, the method comprising:

moving the printing ribbon supplied from the feed spool;

displacing of the thermal print head towards the printing ribbon, the printing ribbon being attached to an outer surface of a loading drum disposed after the thermal print head;

revolving the loading drum to form a loop that determines a constant tension in the printing ribbon during a printing stage; and collecting the loop formed on the loading drum in the take-up spool;

wherein the printing ribbon adheres to the loading drum by the attraction caused by an electric field generated by a voltage potential difference between electrical conductors alternated and distanced on the loading drum, the voltage potential supplied by a d.c. power supply.

* * * * *